US007665710B2

(12) United States Patent
Cooper

(10) Patent No.: US 7,665,710 B2
(45) Date of Patent: Feb. 23, 2010

(54) CONTOURED CONCRETE FORM

(76) Inventor: Alan Cooper, 2997 Buckboard La., Solvang, CA (US) 93463

( * ) Notice: Subject to any disclaimer, the term of this patent is extended or adjusted under 35 U.S.C. 154(b) by 437 days.

(21) Appl. No.: 11/162,400

(22) Filed: Sep. 8, 2005

(65) Prior Publication Data

US 2007/0051865 A1 Mar. 8, 2007

(51) Int. Cl.
*E04G 9/10* (2006.01)
*E04G 11/08* (2006.01)
*E04G 17/065* (2006.01)

(52) U.S. Cl. ..... 249/16; 249/42; 249/190

(58) Field of Classification Search ..... 249/16, 249/42, 140, 162, 168, 190, 213, 216
See application file for complete search history.

(56) References Cited

U.S. PATENT DOCUMENTS 3,292,893 A * 12/1966 Williams ..... 249/42
3,307,822 A * 3/1967 Stout ..... 249/16
3,954,377 A * 5/1976 Scholz et al. ..... 249/16
4,889,310 A * 12/1989 Boeshart ..... 249/216
5,809,725 A * 9/1998 Cretti ..... 52/426

FOREIGN PATENT DOCUMENTS

JP 10292624 * 11/1998 ..... 249/33

* cited by examiner

*Primary Examiner*—Michael Safavi
(74) *Attorney, Agent, or Firm*—Laura N Tunnell

(57) ABSTRACT

The present invention relates to ICF (Insulated Concrete Form) building technology, offering an enhancement to existing practices by presenting a structure and method that enables concrete to be placed and shaped at any angle. In addition, the present invention provides a structure and method that offers aesthetic alternatives to flat surfaces characteristic of existing concrete forming building techniques.

2 Claims, 10 Drawing Sheets

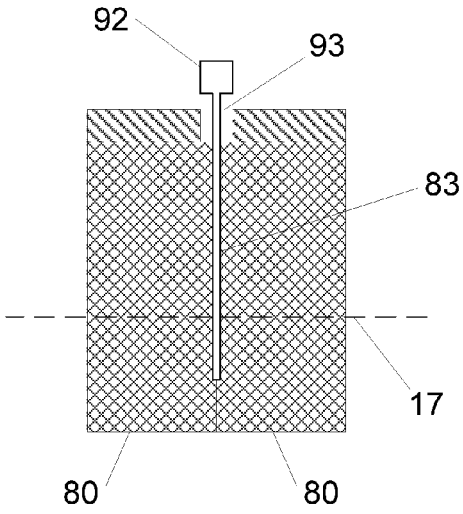
Fig. 9A
Fig. 9B
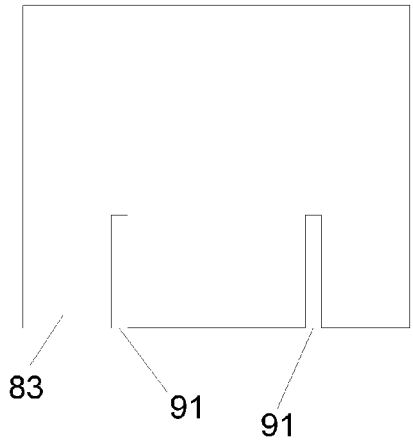
Fig. 9C
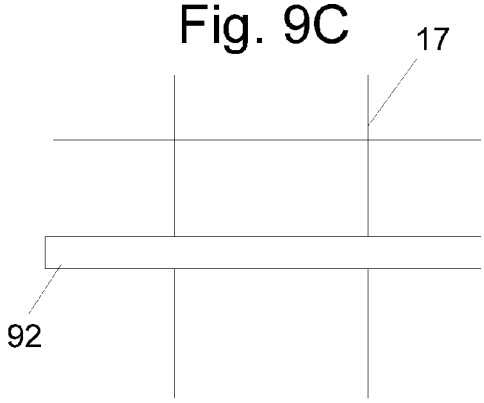

CONTOURED CONCRETE FORM

FIELD OF THE INVENTION

The present invention relates to ICF (Insulated Concrete Form) building technology.

BACKGROUND AND PRIOR ART

Concrete is a compound material made of sand, gravel and cement. The cement is a mixture of various minerals which, when combined with water, hydrate and harden, binding the sand and gravel into a solid mass. The oldest known concrete was found in the former Yugoslavia and is thought to date from approximately 5600 BC. An ongoing lineage of subsequent concrete users included the Egyptians around 2500 BC, followed by the Romans, around 300 BC. Indeed, it is from the Roman words "caementum" meaning a rough stone and "concretus" meaning grown together, that we have obtained the names for these two common materials.

The development of concrete took a further leap forward in the early 1800's with the use of embedded steel reinforcement bars, now popularly known as "rebar". Further advances lead to improved composition and hydration techniques, resulting in such impressive and massive structures as the Hoover Dam. One of the most innovative of recent advances in concrete technology involves the use of Insulating Concrete Forms (ICF).

The term "ICF" is an acronym for an Insulating Concrete Form. ICF's are hollow forms comprised of expanded polystyrene (EPS), an innovative building material that lends to the design and structural integrity of many building projects. ICF's are erected at the construction site, filled with four to twelve inches of reinforced concrete, and left in place after the concrete cures. Requiring little maintenance, naturally resistant to fires and other natural disasters, ICF structures are durable, quiet and comfortable.

As is characteristic of many rapidly developing technologies, ICF construction tools and techniques still have many limitations to overcome. In practice, ICF components have been largely restricted to either vertical or horizontal placement configurations such as vertical walls and flat roofs. ICF technology has not been optimized for tilted configurations such as angled roofs.

The present invention allows for the possibility of retaining a system of reusable ICF molds in any position under the pressures of hydraulic concrete regardless of the system's location or angled configuration.

SUMMARY

Currently, ICF's simply serve to contain the liquid concrete between two opposing, connected sides of a flat and permanent mold. Their purpose is to confine the fluid concrete and add insulation to the hardened building wall. The permanent position of the mold negates the possibility of being visually inspected for quality or for exploiting its aesthetic potential for shape. Furthermore, the ICF panels of the current art are designed only for vertical stacking and vertical positioning.

The design of the present invention may be positioned at any angle by providing a load path for the imposing hydraulic forces generated by liquid flowing concrete. These forces are directed, or transferred from the mold to the opposite supporting side of the structure. Because the mold is designed for only temporary support, it can be removed once the concrete has hardened. This opens up new possibilities for use. In particular, the contacting surface of the mold can be shaped. Consequently, the complementary contacting concrete surface will retain a relief of the mold shape once it is removed. Using this mold system, the concrete can take on the appearance of rocks, slate, wood shake and shingles, mission tiles, etc., virtually any topology that can be accommodated by a two dimensional surface. The mold and its interconnecting pieces can be re-used again and again. Moreover, the mold is attached to the base by means of threaded connections which remain after removal of the mold, thereby providing potential points of attachment for other building components such as structural cross members, shelves, etc.

Other applications of the prior art involve the use of EPS (expanded polystyrene) in flat decking or flooring structures. These design configurations exploit void volumes containing reinforcing steel. When such volumes are filled by concrete, the result is a beam shape capable of supporting loads spanning unsupported distances. These "poured-in-place", generally horizontal structures may also be lifted and relocated to a vertical wall position after hardening.

The design of the present invention attaches to a prior art EPS base and contains the liquid concrete so that that it can be poured, or pumped, at any angle. Furthermore, the temporary function of the mold, together with its containment ability, allows the concrete to be shaped as part of the placement and curing process.

Clear viewing windows or portals are manufactured in the mold to allow for the observation of the concrete during placement. Although the mechanical connection of the mold to the prior art flooring/decking substructure system allows the possibility for sloping, vertical, horizontal, or inverted positions to serve as roofs, walls, or bottom sides of poured concrete structures, it is nevertheless important to retain the capability of monitoring the progress of the concrete pour as it is taking place. The viewing portals serve this function.

Commonly called "poured-in-place" concrete structures, plywood and supporting wood framing are also used to constrain the liquid concrete from movement during hardening, and to support reinforcing members placed within the concrete. These temporary wood structures are removed after hardening, leaving the surface of the concrete flat and unshaped. The invention disclosed herein is designed to attach to a supporting plywood surface, and to replace the opposing side of the plywood forming structure. The shaped mold will produce shaped contours on the surface of the vertical, or tilted, concrete structure.

Wood framed building structures commonly use plywood as the supporting material for roof finish material. The replacement of the roof material requires exposure of the plywood surface for structural integrity observations. The present invention is intended to promote the use of lightweight concrete mixtures, shaped by the mold surface, to replace outdated, deteriorated, traditional roofing materials.

It is an objective of the present invention to provide a shaped mold system for concrete to be used in conjunction with existing ICF wall or flooring/decking components and is easily used by untrained workers.

It is an objective of the present invention to provide a shaped mold system to be used in conjunction with existing building system components that is removable and reusable.

It is an objective of the present invention to provide a shaped mold system component to be used in conjunction with existing building structures and their components, or newly constructed ICF or traditional construction practices enabling concrete mixtures to be poured, pumped, or otherwise placed and cured at any angle or location.

It is an objective of the present invention to provide a shaped mold system to be used in conjunction with a variety of prior arts that enables at least one surface of the concrete to be shaped.

It is an objective of the present invention to provide a shaped mold system component to be used in conjunction with existing components that provides a surface of sufficient structural integrity for supporting construction workers and the loads of related materials and equipment.

It is an objective of the present invention to provide a system of components that will allow mechanical threaded connections for attachment of building components after the mold assembly is removed.

The above objects and advantages of the present invention are accomplished by a removable mold assembly for use with existing insulating concrete form components. The assembly comprises a fixed base component, a removable upper component, and constraining side members forming a concrete fillable volume therebetween. The fixed base component accommodates a plurality of lower securement members and the removable upper component accommodates a plurality of upper securement members. The upper securement members are adapted to engage the lower securement members to form a plurality of reinforcement posts within the concrete-fillable volume. The removable upper component has an inside surface and an outside surface with respect to the concrete-fillable volume. The inside surface has a textured topology operable for imparting its shape to concrete curing within the concrete-fillable volume.

The features of the invention believed to be novel are set forth with particularity in the appended claims. However, the invention itself, both as to organization and method of operation, together with further objects and advantages thereof may best be understood by reference to the following description of a preferred embodiment of the invention, taken in conjunction with the accompanying drawings in which:

DESCRIPTION OF PREFERRED EMBODIMENT

The definitions below serve to provide a clear and consistent understanding of the specification and claims, including the scope given to such terms.

The term "rebar", as used herein, refers to a steel rod that commonly functions as a supplemental alignment and support component.

The term "ICF", as used herein, is an acronym for an Insulating Concrete Form such as is sold under the tradename "Quadlock". An ICF essentially provides all or part of the containing surfaces of a volume to be filled with concrete. The surfaces are lined with insulating styrofoam, as the term suggests.

The term "steel wire reinforcement mesh", as used herein, comprises a set of crossed wires arranged in a grid pattern. A 6"×6" square pattern of #8 wire is one choice commonly used in the industry.

DESCRIPTION OF FIGURES

FIG. 9A: Illustration of separator plate partially removed from adjoining filled concrete volumes.

FIG. 9B: Front view of separator plate.

FIG. 9C: Top view of separator plate.

DESCRIPTION OF NUMERALS USED IN FIGURES

10—Mold system
12—Removable mold component
13—Non-removable base component
14—Upper securement member
15—Lower securement member
16—Mold reinforcement bracket
17—Steel wire reinforcement mesh
18—Concrete fill space
20—Base sheet
21—Lower surface of base sheet
22—Upper surface of base sheet
23—Projection of precut openings to accommodate lower securement members
30—Lower surface of removable mold component
31—Upper surface of removable mold component
32—Viewing port
40—Bracket assembly
41—Bracket spine
42—Tongue pairs
43—Bracket notch
50—Bolt head
51—Washer
52—Bolt shaft
53—Notch within both shaft capable of receiving bracket notch
54—Threaded end capable of mateably connecting with receiving counterpart in lower securement member
60—Base plate of lower securement member
61—Post
62—Block comprising lower part of post

63—Cylinder comprising upper part of post
64—Holes capable of receiving a supplemental alignment and support component (rebar)
65—Notch for attachment to steel wire reinforcement mesh
66—Threaded acceptor site capable of receiving threaded component of upper securement member
70—Arrow indicating the direction of cement deposition
71—Partially filled mold assembly
80—Filled mold volume
81—Partially filled mold volume
82—Empty mold volume
83—Separator plate
91—Notches to receive steel wire reinforcement mesh
92—Separator plate head
93—Trench for separator plate head
100—Prior art base assembly
101—I-Beam void of prior art base assembly
102—Supplemental alignment and support component (rebar)
103—Abbreviated lower securement member
104—Rebar attachment to supporting lower securement member

DETAILED DESCRIPTION OF PREFERRED EMBODIMENT

Figure 1A:
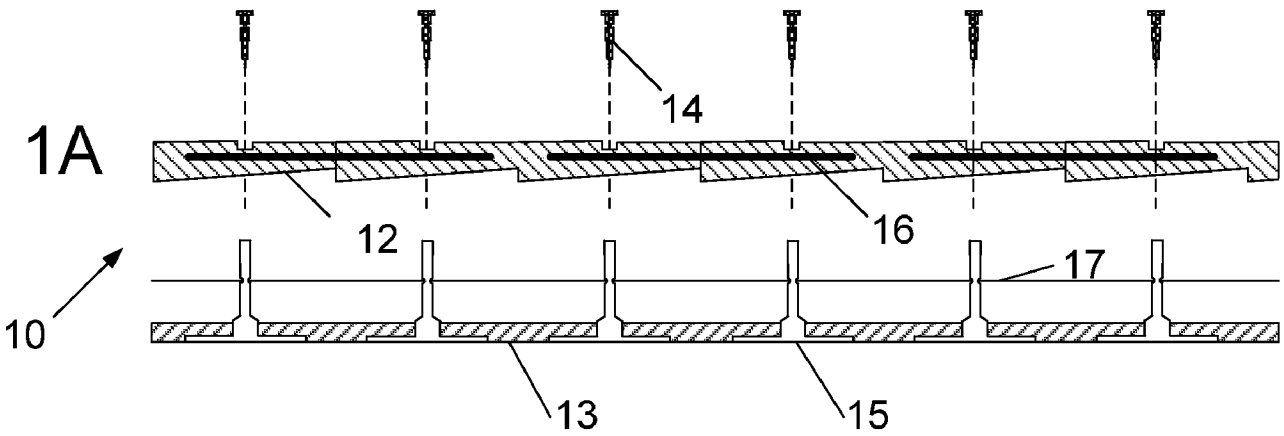
FIG. 1A: Cross section of mold system in an unassembled configuration.
Figure 1B:
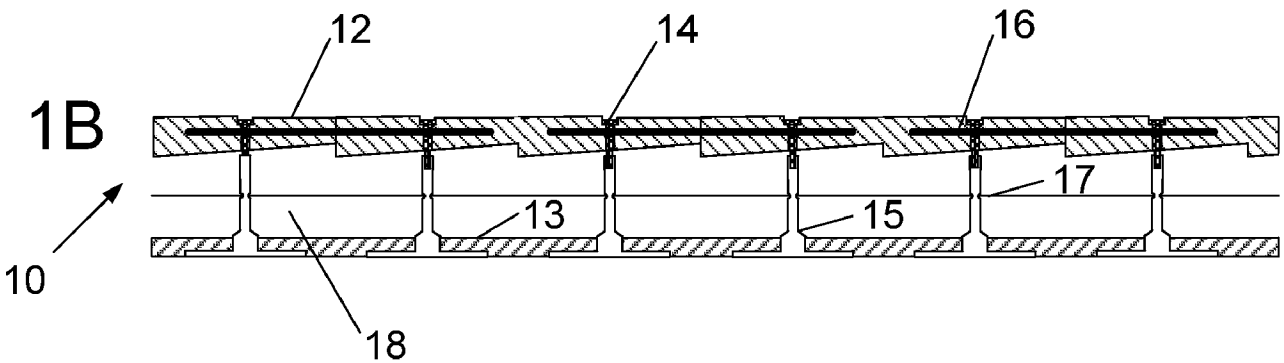
FIG. 1B: Cross section of mold system in an assembled configuration.

A cross section of the mold system (10) in an unassembled configuration is shown in FIG. 1A; the assembled configuration is shown in FIG. 1B. The removable mold component (12) opposes and mates to the non-removable base component (13) by means of a plurality of upper (14) and lower (15) securement members. A mold reinforcement bracket (16), described in more detail in the ensuing paragraphs, is integral with the removable mold component (12). The lower securement members (15) provide provisions for the securement of a standard steel wire reinforcement mesh (17). In the assembled configuration, the removable mold component (12) and the non-removable base component (13) define a concrete fill space (18) therebetween.

Figure 2B:
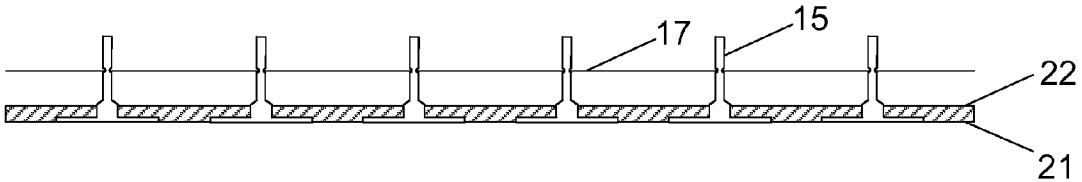
FIG. 2B: Cross section of non-removable base component taken along line 2B-2B of FIG. 2A.
Figure 2A:
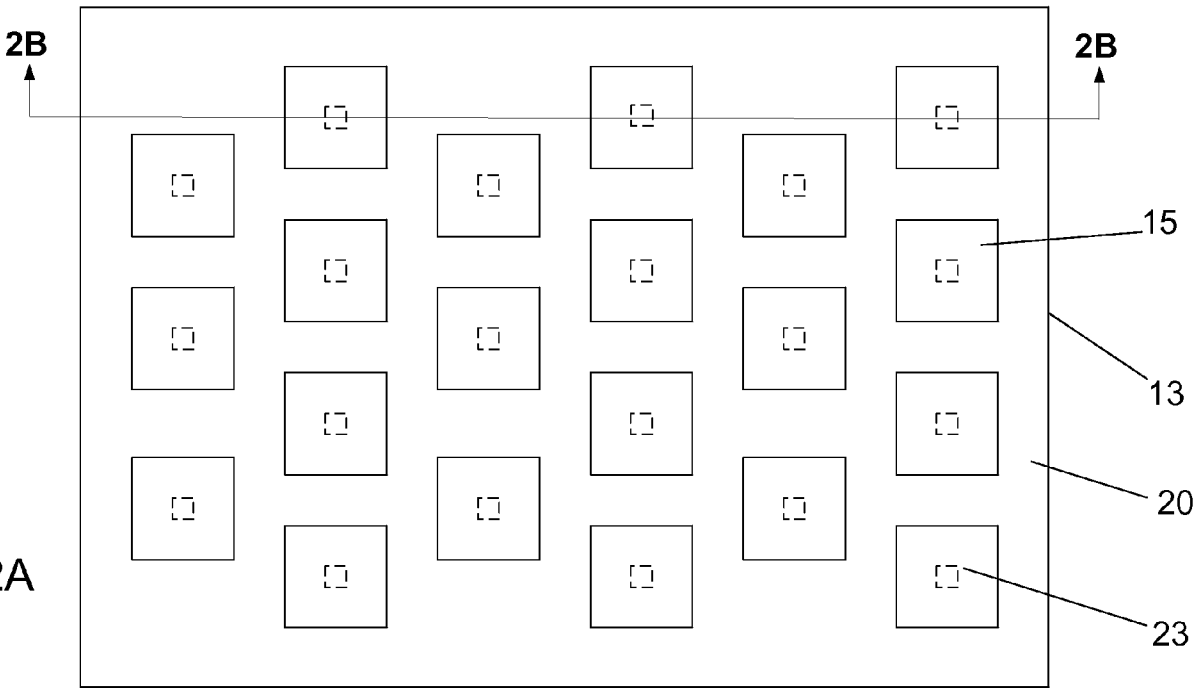
FIG. 2A: Plan view of non-removable base component.

The non-removable base component (13), illustrated in plan view in FIG. 2A and elevation view in FIG. 2B, is comprised of a base sheet (20) and a plurality of lower securement members (15). As suggested in FIG. 2B, the non-removable base component is constructed by inserting the lower securement members (15) from the underside (21) of the base sheet (20) through precut openings, the outlines of which are indicated at (23).

Figure 6B:
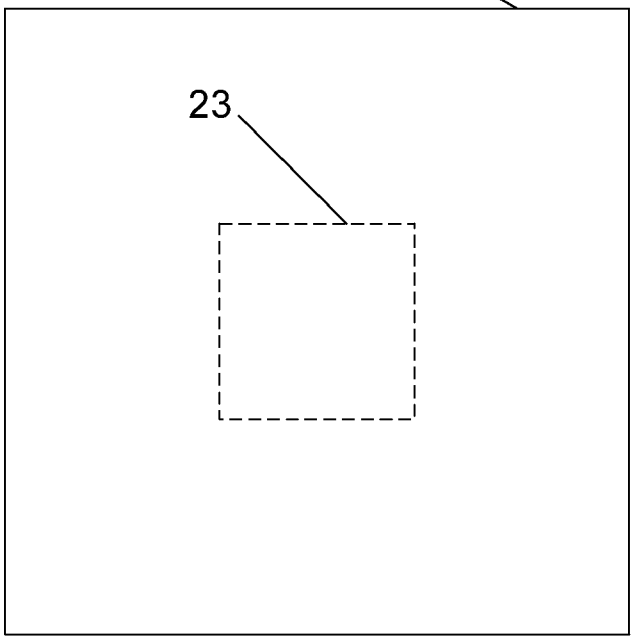
FIG. 6B: Plan view of the lower securement member.
Figure 6A:
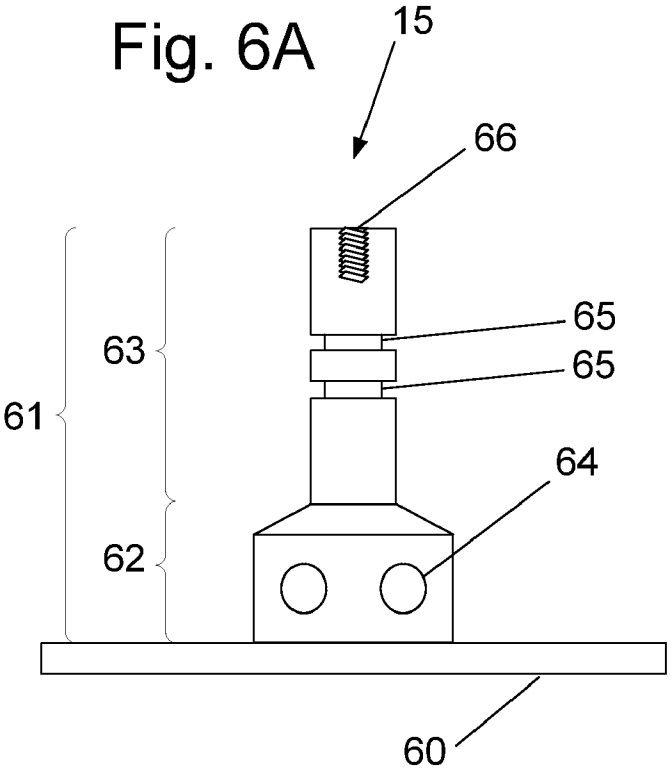
FIG. 6A: Elevation view of the lower securement member.
Figure 10:
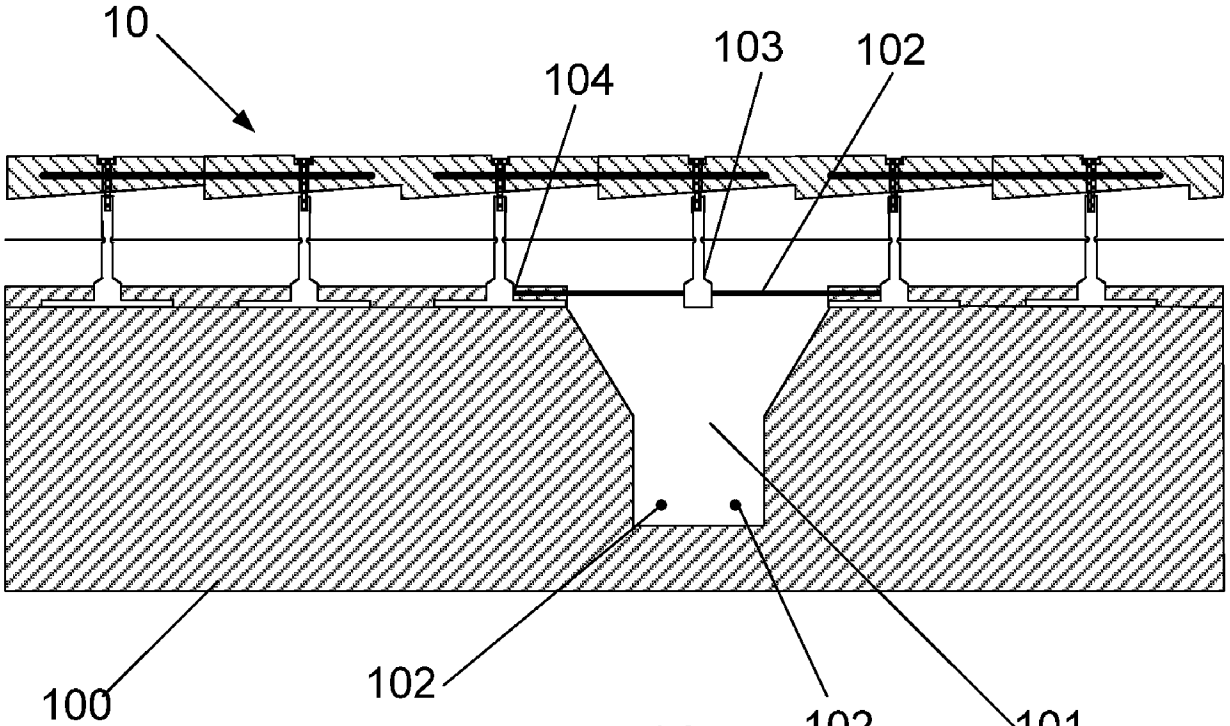
FIG. 10: Mold assembly of present invention utilized in concert with prior art mold assembly.

A candidate lower securement member (15), shown in more detail in FIG. 6A and FIG. 6B, is essentially comprised of an optional base plate (60) and a post (61). The optional base plate (60) is designed to lie flush with the underside (21) of the base sheet (20). The post (61), comprised of a block (62) and a cylinder (63), stands taller than the upper surface (22) of the base sheet (20). Optional holes (64) bored through the block (62) are capable of receiving rebar and are important for applications such as shown in FIG. 10. Steel wire reinforcement mesh (17) can be attached to notches (65) in the cylinder (63) comprising the upper part of the post (61). A threaded acceptor site (66) at the top of the cylindrical section is capable of mating to a complementary threaded component of the upper securement member (14). The same threaded acceptor site (66) is left behind when the removable mold component (12) is in fact removed, thereby providing permanent point of attachment for other building components such as cross-members, shelving, etc.

Figures 3A, 3B:
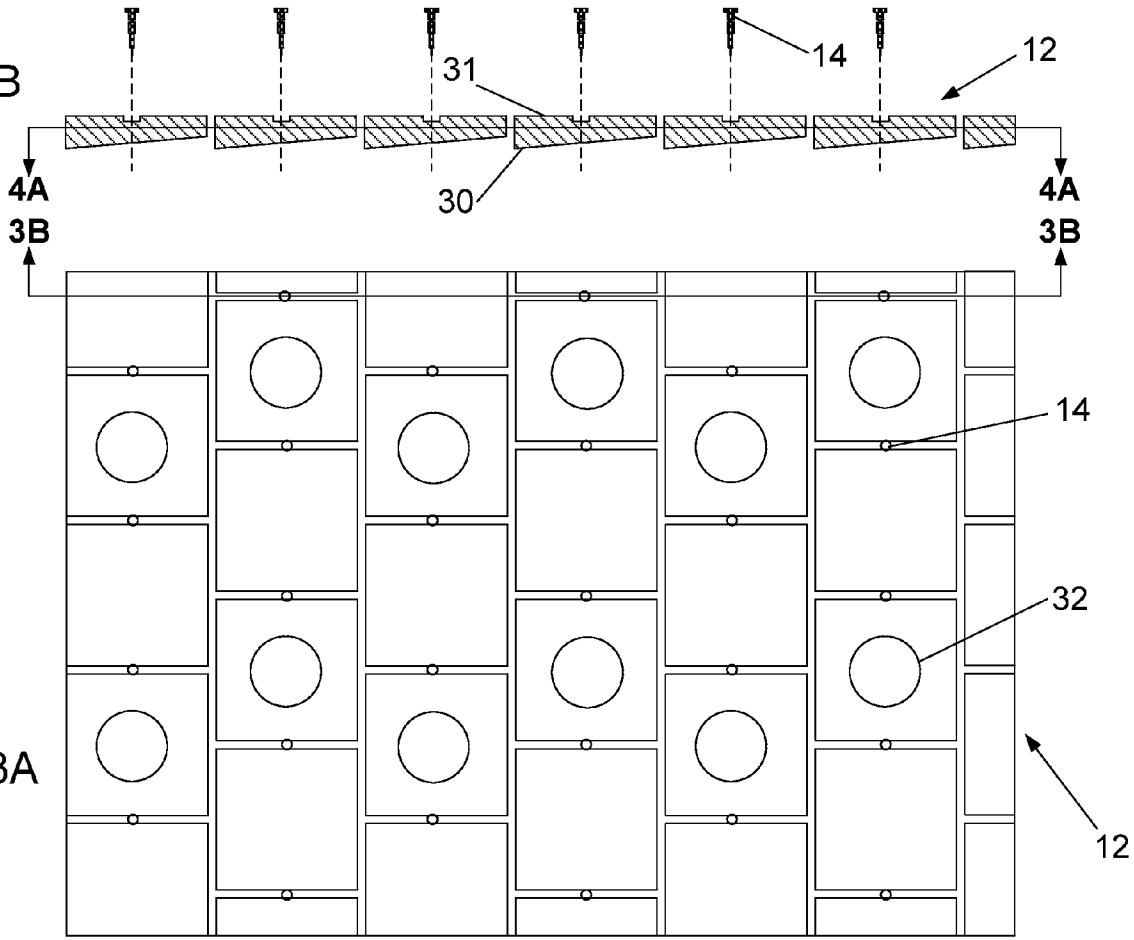
FIG. 3A: Plan view of removable mold component.
FIG. 3B: Cross section of removable mold component taken along line 3B-3B of FIG. 3A.

FIG. 3A shows a plan view, and FIG. 3B an elevation view of the removable mold component (12). Both the upper surface (22) of the non-removable base component (13) and the lower surface (30) of the removable mold component (12) define the volume comprising the concrete fill space (18). After the concrete has sufficiently cured and the removable mold component (12) is indeed removed, the concrete will retain the shaped of its lower surface (30). This feature enables the concrete to conform to virtually any topology from which a mold can be made. Although the example illustrates a form that mimics standard house shingles, it is not limited as such. A mold could just as easily be constructed to produce a concrete form having the topology of mission tiles, for example.

Figure 5B:
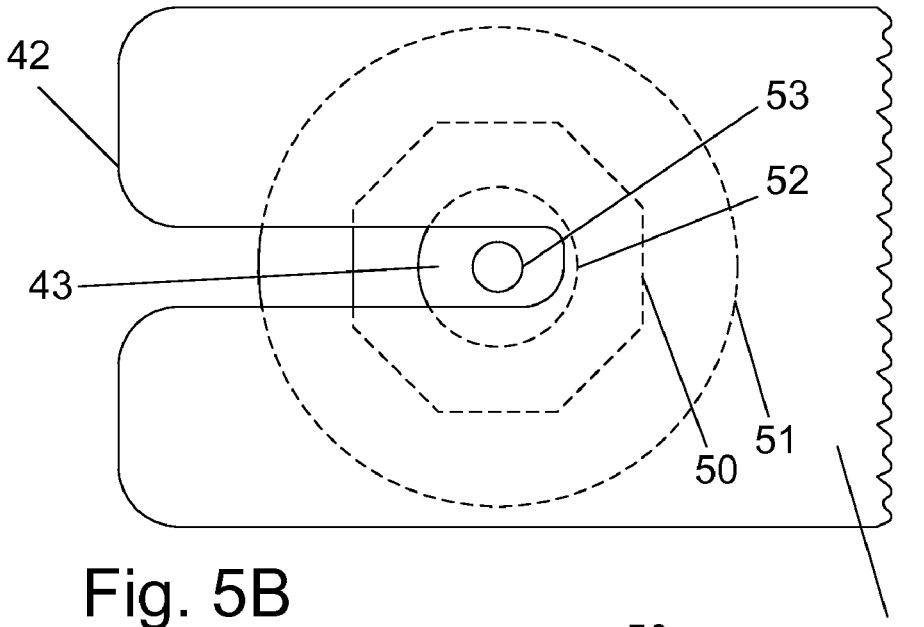
FIG. 5B: Illustration of the functional relationship between the upper securement member and the bracket.
Figure 5A:
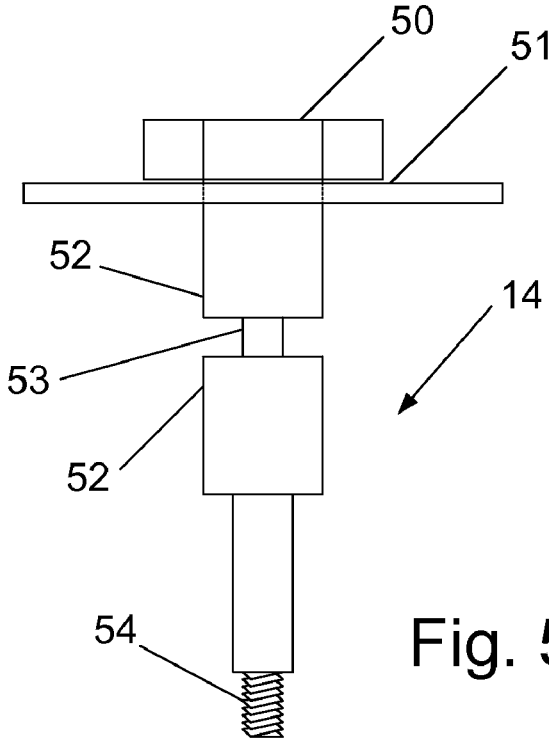
FIG. 5A: Illustration of the preferred embodiment of the upper securement member.

An example of a candidate upper securement member (14) is shown in FIG. 5A. It essentially comprises a bolt having a threaded shaft (54) that is mateable to the threaded acceptor site (66) of the lower securement member (15). In an alternative embodiment, the upper securement member (14) is mateable to a resident connector site on a standard ICF panel.

Figure 4B:
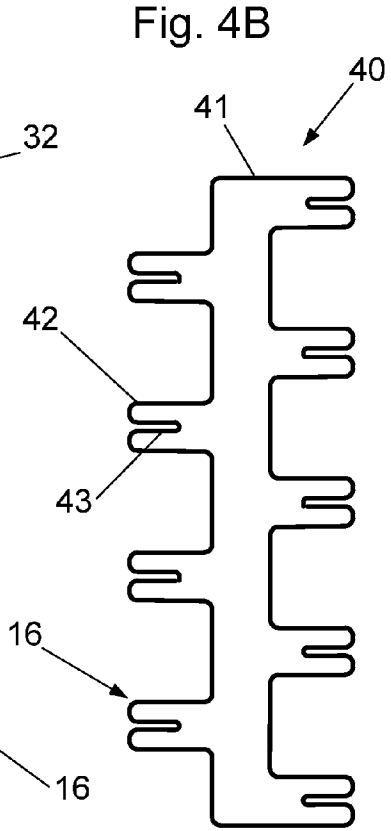
FIG. 4B: Illustration of the bracket in isolation.
Figure 4A:
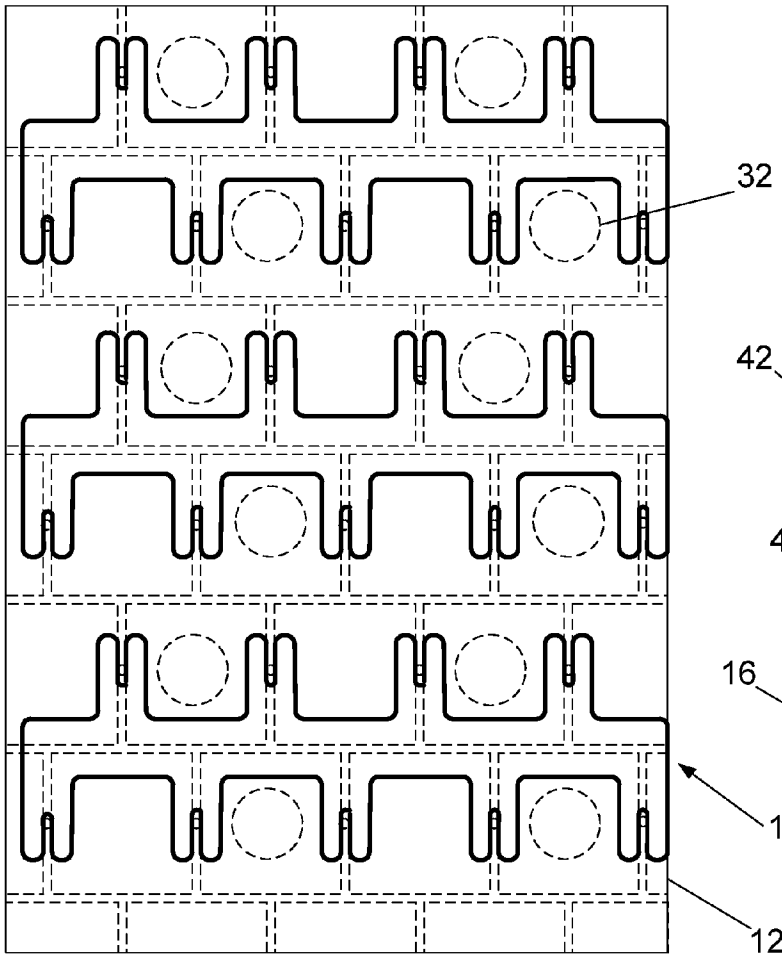
FIG. 4A: Plan view of bracket indicated along 4A-4A in FIG. 3B illustrating the bracket position with respect to the upper mold assembly (shown in phantom).

The purpose of other details depicted in FIG. 5A and FIG. 5B can be understood from FIG. 4A which shows a plan view of the bracket indicated along line 4A-4A of FIG. 3B. FIG. 4A illustrates the bracket position with respect to the upper mold assembly where the upper mold assembly is shown in phantom. FIG. 4B illustrates the bracket in isolation.

The bracket (40) is essentially comprised of a spine (41) from which a plurality of tongue pairs (42) outcrop. Each tongue pair (42) has a bracket notch (43) that slideably engages with a notch (53) cut into the bolt shaft (52) of the upper securement member (14) as indicated in FIG. 5A. The bolt head (50) and washer (51) serve to keep the bolt fixably positioned to lie flush with the upper surface (31) of the removable mold component (12).

In the assembled position, the bracket (16) and mated upper (14) and lower (15) securement members provide structural integrity to the entire mold system. Workers and equipment can be maneuvered on the upper surface of the removable mold component (31) without compromising any structures underneath.

Figures 7A, 7B, 7C:
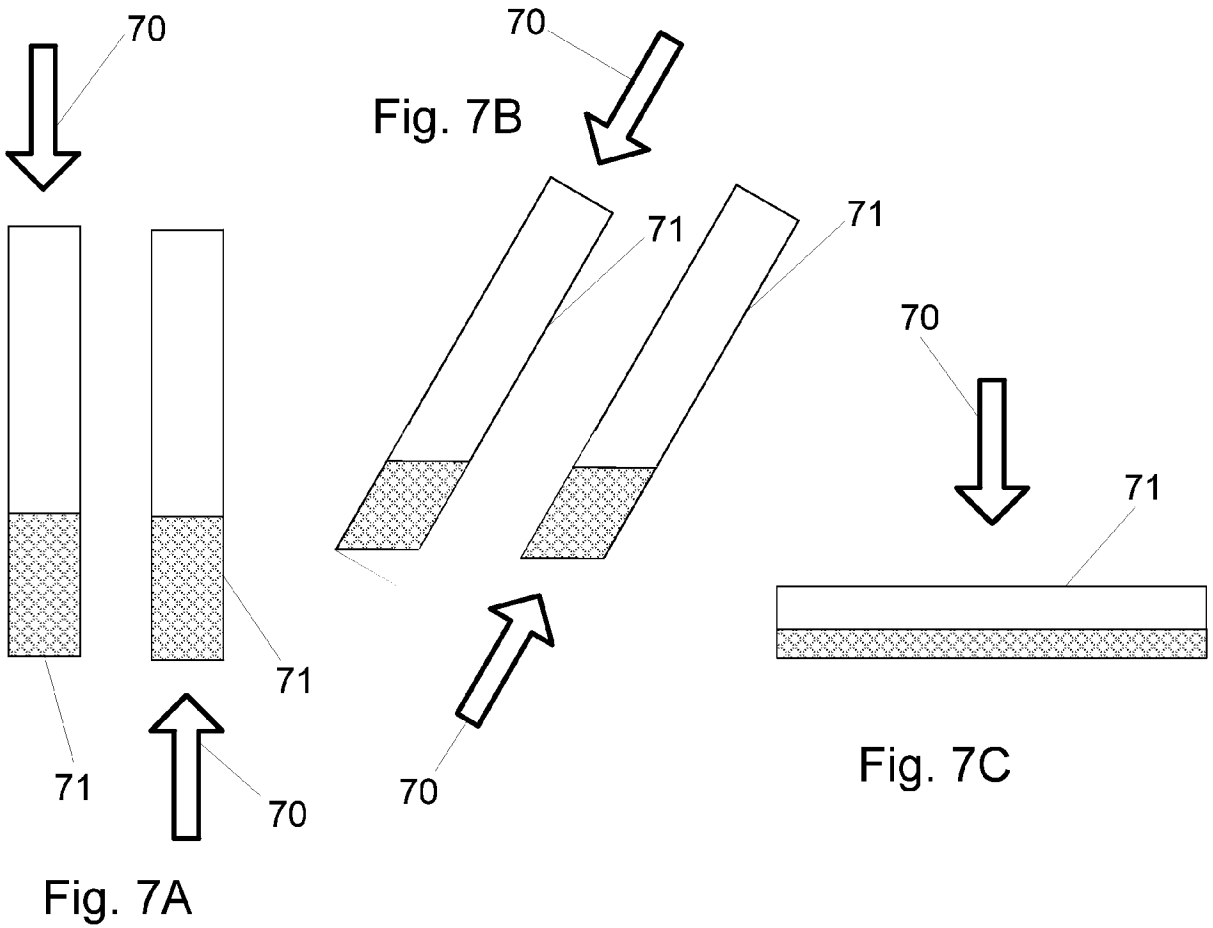
FIG. 7A: Schematic of concrete deposition in vertical wall fillable from either the top or the bottom of the mold.
FIG. 7B: Schematic of concrete deposition for a wall or roof set at an angle between zero and 90 degrees with respect to the vertical.
FIG. 7C: Schematic of concrete deposition for a flat configuration.
Figure 8A:
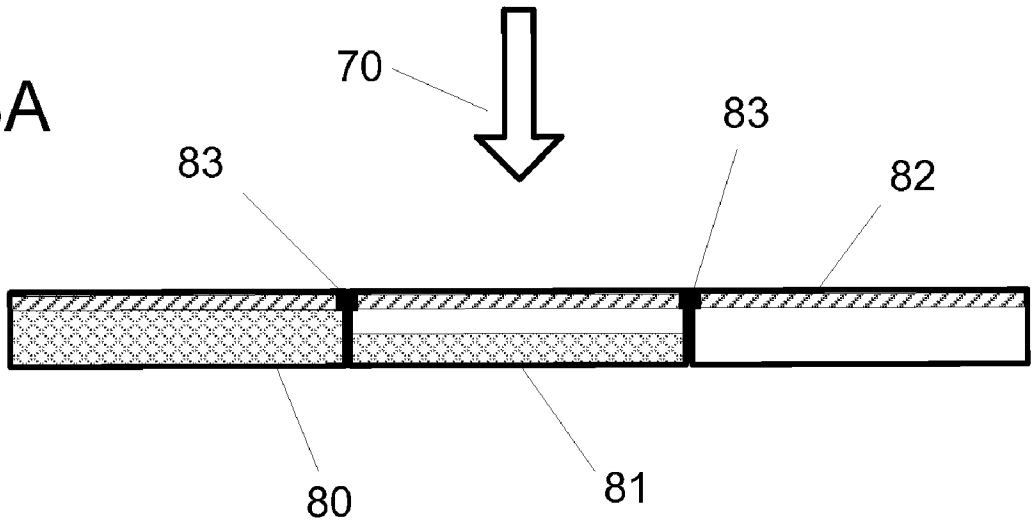
FIG. 8A: Schematic of concrete deposition process showing a separator plate isolating a fully filled compartment from a partially filled adjoining compartment, thereby enabling complete consolidation of the two volumes comprising each compartment.
Figure 8B:
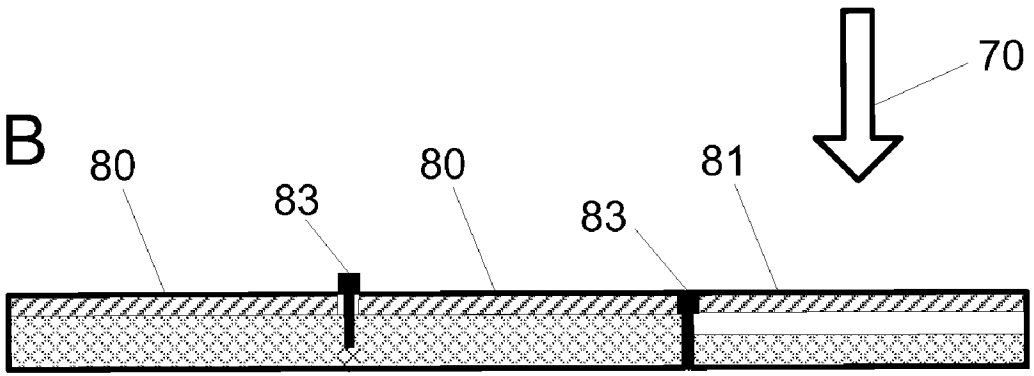
FIG. 8B: Schematic of concrete deposition process showing a separator plate being removed from fully filled adjoining compartments.

FIG. 7A, FIG. 7B and FIG. 7C are notional illustrations depicting the various pour methods that are possible using the present design. Essentially, the concrete can be poured from the top or inserted from the bottom (70) regardless of the alignment of the assembly. In any case, the concrete is poured in sections, where each section is separated its neighbor by a separator plate (83) as shown in FIG. 8A and FIG. 8B. As neighboring sections become filled, the separator plates are removed, thereby allowing the concrete from the two sections to meld together.

The separator plate, (83), is shown in more detail in FIG. 9A, FIG. 9B, and FIG. 9C. Notches (91) are cut in the plate in order to accommodate standard 6" span of the steel wire reinforcement mesh (17). When in a closed position, the separator plate head (92) lies within a small trench (93), flush with the upper surface of the mold assembly. Optional trenches can be cut into the upper surface of the base sheet (22) to insure further stability of the separator plate (83).

A specialized application of the system is shown in FIG. 10. Here, a prior art base assembly (100) includes an I-Beam shaped void (101). Filling the void with concrete results in the familiar shape of an I-Beam support. The design of the present disclosure allows exploitation of the I-Beam void by utilizing its track length as a conduit for precise and effective concrete placement.

The elements of the present invention accommodate the interruption in the base support structure due to the I-Beam void by using an abbreviated version (103) of the lower securement member shown in FIG. 6A. Here, the base plate (60) is omitted and the post is suspended across the gap of the void (101) by means of a supplemental alignment and support component, or "rebar" (102), inserted through the holes (64) of the abbreviated lower securement member (103). The ends of the rebar are attached (104) to the immediately adjacent lower securement members by use of set screws tapped into the respective holes (64).

The invention as described herein provides a shaped mold system to be used in conjunction with existing ICF wall or flooring/decking components that enables concrete mixtures to be poured, pumped, or otherwise placed and cured at any angle or location. Unlike prior art systems, wherein the concrete is either poured flat or is sandwiched between two permanent surfaces, at least one surface of the poured concrete is constrained by a removable surface (30) that transfers its shape to the curing concrete. A multitude of possibilities for aesthetic treatment of the exposed concrete surface can then be realized.

More particularly, the non-removable base (13), provided by prior art components, can be easily modified to accommodate the lower securement members (15). The removable mold component (12), provided by this invention, attaches to the non-removable base (13) by means of the upper (14) and lower (15) securement members. This allows the system to be easily assembled and disassembled by untrained workers.

Other objectives met by this invention include threaded acceptor sites (66) remaining behind after disassembly that can either be plugged or provide support for subsequent re-attachment to other structural cross members, shelving, etc. A mold reinforcement bracket (16), an integral part of the removable mold component (12), provides a surface of sufficient structural integrity for supporting construction workers and the loads of related materials and equipment. In addition, the removable mold component (12) can be used time and again, resulting in significant cost savings for the builder.

While particular embodiments of the present invention have been illustrated and described, it would be obvious to those skilled in the art that various other changes and modifications can be made without departing from the spirit and scope of the invention. For example, the particular shape of the mold reinforcement bracket (16) and its method of incorporation into the removable mold component (12) can take on a variety of forms. The essential idea is to exploit the useable upper surface of the removable mold component (12) by providing a work platform for personnel and equipment. Attachment means between the removable mold component (12) and the non-removable base component (13) can be attained by using non-threaded couplings, for example. Such a connection may facilitate faster assembly and disassembly. In a similar vein, the shape, placement, and frequency of the viewing ports can be easily re-designed to meet any set of specifications. All of the above are examples of ideas that depart from the literal recitation, but not the spirit, of the invention.

What is claimed is:

1. A removable mold assembly for use with existing insulating concrete form components, said assembly comprising:

A fixed base component, a removable upper component, a weight supporting bracket, and a plurality of removable side members, wherein said fixed base component accommodates a plurality of lower securement members, said removable upper component accommodates a plurality of upper securement members, said plurality of upper securement members being adapted to engage said plurality of lower securement members, forming a plurality of reinforcement posts within a system of concrete-fillable volumes, wherein each of said concrete-fillable volumes is bounded by said fixed base component, said removable upper component, and two of said plurality of removable side members, wherein said removable upper component has an inside surface and an outside surface with respect to said system of concrete-fillable volumes, said outside surface being regularly scored with a system of trenches, said inside surface having a textured topology operable for imparting its shape to concrete curing within said system of concrete-fillable volumes, wherein said weight supporting bracket is integral with said removable upper component and rigidly mateable to each of said plurality of reinforcement posts thereby providing structural integrity to said system of concrete-fillable volumes, and wherein each of said plurality of removable side members comprises a rigid, rectangular sheet insertable into said system of trenches, thereby enabling each of said system of concrete-fillable volumes to be separately filled and subsequently consolidated upon removal of said plurality of side members.

2. A method of producing a shaped concrete surface poured at any angle comprising the steps of:

a. Presenting a removable mold assembly as in claim 1, b. Attaching said plurality of lower securement members to an existing insulating concrete form, c. Attaching said removable upper mold assembly by engaging said upper securement members with said lower securement members, d. Inserting said plurality of removable side members into said system of trenches, creating a system of concrete-fillable volumes therein, e. Introducing concrete into each of said system of concrete-fillable volumes, f. Allowing each of said system of concrete-fillable volumes to be thoroughly and uniformly filled with concrete, g. Removing said plurality of removable side members, thereby enabling said system of concrete-fillable volumes to consolidate.

* * * * *